US006736331B2

(12) United States Patent
Boecking

(10) Patent No.: US 6,736,331 B2
(45) Date of Patent: May 18, 2004

(54) VALVE FOR CONTROLLING FLUIDS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/181,482

(22) PCT Filed: Jan. 13, 2001

(86) PCT No.: PCT/DE01/00122

§ 371 (c)(1),
(2), (4) Date: Oct. 15, 2002

(87) PCT Pub. No.: WO01/53685

PCT Pub. Date: Jul. 26, 2001

(65) Prior Publication Data

US 2003/0089794 A1 May 15, 2003

(30) Foreign Application Priority Data

Jan. 22, 2000 (DE) ..... 100 02 702

(51) Int. Cl.[7] ..... F02M 59/46; F02M 45/02

(52) U.S. Cl. ..... 239/88; 91/52; 123/446; 239/90; 239/92; 239/96

(58) Field of Search ..... 123/446, 496, 123/447, 458; 239/88, 89, 90, 91, 92, 96; 91/52

(56) References Cited

U.S. PATENT DOCUMENTS

| | | | | | |
|---|---|---|---|---|---|
| 3,477,344 | A | * | 11/1969 | Fisher | 91/52 |
| 5,241,935 | A | * | 9/1993 | Beck et al. | 123/467 |
| 5,738,075 | A | * | 4/1998 | Chen et al. | 123/446 |
| 6,637,409 | B2 | * | 10/2003 | Brenk et al. | 123/467 |
| 2003/0089794 | A1 | * | 5/2003 | Boecking | 239/89 |

FOREIGN PATENT DOCUMENTS

| | | | | |
|---|---|---|---|---|
| DE | 197 16 221 | A | 10/1998 | |
| GB | 2324343 | A | * 10/1998 | F02M/59/46 |
| WO | WO 01/11227 | A | 2/2001 | |

* cited by examiner

*Primary Examiner*—Sheldon J. Richter
(74) *Attorney, Agent, or Firm*—Ronald E. Greigg

(57) ABSTRACT

A valve for controlling fluids, having an inflow line and a leak fuel line, which each communicate with a pressure chamber. A piston element is adjustable by a control element and opens and closes a first passage between the inflow line and the pressure chamber. The piston element has a slide element, which is disposed directly at the seat of the piston element. The stroke length of the slide element for opening the first passage is greater than or equal to the stroke length for closing a second passage between the pressure chamber and the leak fuel line.

20 Claims, 2 Drawing Sheets

VALVE FOR CONTROLLING FLUIDS

CROSS-REFERENCE TO RELATED APPLICATIONS

This application is a 35 U.S.C. 371 application of PCT/DE 01/00122, filed on Jan. 13, 2001.

BACKGROUND OF THE INVENTION

1. Field of the Invention

The invention relates to a valve for controlling fluids and more particularly to such a valve especially useful in a fuel injection system.

2. Description of the Prior Art

From European Patent Disclosure EP-0 477 401 A1, a valve is known in which an actuating piston of a valve member is disposed displaceably in a stepped bore of the valve housing, in a part of the stepped bore that has a small diameter. A larger piston movable by a piezoelectric actuator is disposed in a part of the stepped bore having a larger diameter. Between the two pistons, a hydraulic pressure chamber filled with a pressure medium is embodied, so that a hydraulic boost of a motion of the piezoelectric actuator occurs. That is, when the large piston is moved a certain distance by the piezoelectric actuator, the actuating piston of the valve member executes a stroke lengthened by the boosting ratio of the piston diameter, since the piston of the piezoelectric actuator has a larger surface area than the actuating piston of the valve member.

In such valves, 3/2-way control valves are also used, as disclosed for instance in U.S. Pat. No. 5,738,075. Such 3/2-way control valves can be embodied as seat-slide or seat-seat valves. Here the pressure is carried from a rail, for instance, by means of a controllable piston via a pressure chamber and a booster piston to a control chamber, from which the fuel is injected into the combustion chamber. In the nonactuated state, the pressure chamber is connected to a leak fuel line, so that leak fuel pressure prevails in the pressure chamber. However, upon a switchover of the 3/2-way control valve, regardless of the type of valve (seat-slide or seat-seat valve), a communication briefly occurs between the high-pressure region and the leak fuel region. The result is a so-called diversion surge into the leak fuel line. This hinders the relief of the control chamber of the valve until the valve has sealed off the opening to the high-pressure region.

SUMMARY OF THE INVENTION

The valve for controlling fluids according to the invention has the advantage that a diversion surge to the leak fuel line of this kind does not occur. It is prevented by disposing a slide element upstream of the seat of the control valve. The slide element is disposed in the opening direction immediately before the piston region with which the piston takes its seat on the valve seat. Depending on the stroke path of the slide element, this makes a delayed opening of the passage between the inflow line and the pressure chamber, but enables an immediate closure of the passage between the inflow line and the pressure chamber. Thus at any instant upon switchover of the control valve, it can be assured that there will be no communication between the inflow line and the leak fuel line. Because of the provision of the slide element, the stroke path of the piston for opening the communication between the inflow line and the pressure chamber is at least equal to but advantageously greater than a stroke path for closing or opening a passage between the pressure chamber of the control valve and the leak fuel line. As a result, the diversion surge into the leak fuel line can advantageously be prevented. Also advantageously, upon switchover of the control valve, the relief of the control chamber is no longer hindered, since because of the slide element, sealing off from the high-pressure region occurs immediately.

In an especially advantageous way, the slide element of the piston is embodied cylindrically. As a result, on the one hand simple production of the slide element can be achieved, and on the other, this makes an overall simple design of the control valve possible.

Advantageously, the piston of the control valve is embodied in two parts. As a result, a seat-slide valve with a pressure chamber disposed between the two parts can be realized. Especially advantageously, the control valve is embodied as a force-compensating valve. The guide diameter at the valve seat then is equivalent to the diameter of the slide element.

Also advantageously, the piston of the stepped bore is embodied in one piece. As a result, a 3/2-way seat-slide valve can be used as an outlet valve.

Preferably, the valve for controlling fluids is embodied as a 3/2-way seat-slide valve or as a 3/2-way seat-seat valve.

Overall, with the valve of the invention, an unambiguous function of a control valve without a diversion surge from the high-pressure inlet region into the leak fuel line can thus be achieved. By varying the stroke lengths or stroke paths of the slide element at the valve seat or the stroke length for closing/opening the communication with the leak fuel line, the overlap at the leak fuel slide element can be optimized.

Depending on the intended application, an optimal slide ratio can be formed of the various stroke lengths. The overlap should be selected such that no significant valve delays occur, yet it is still assured that no diversion surge into the leak fuel line will occur.

BRIEF DESCRIPTION OF THE DRAWINGS

In the drawing, two exemplary embodiments of the invention are shown. The exemplary embodiments are explained in further detail in the ensuing description. Shown are.

DESCRIPTION OF THE PREFERRED EMBODIMENTS

Figure 1:
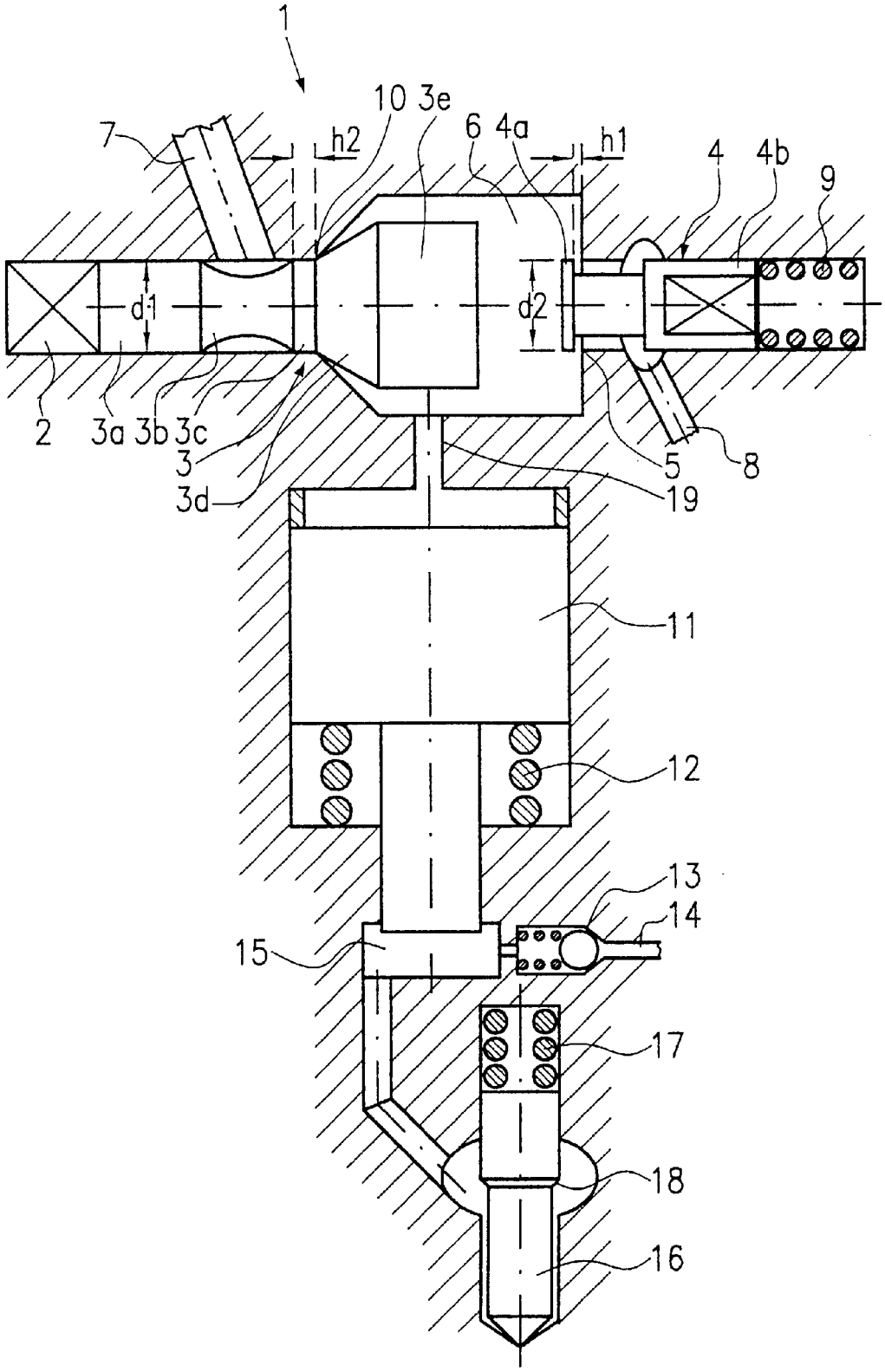
FIG. 1, a schematic sectional view through a fuel injection valve in a first exemplary embodiment of the present invention.

In the exemplary embodiment shown in FIG. 1, the valve of the invention is used in a pressure-boosted common rail injector. The valve of the invention is embodied here as a 3/2-way seat-slide control valve 1.

In FIG. 1, a fuel injection valve in a first exemplary embodiment of the present invention is shown. The fuel injection valve includes the 3/2-way control valve 1. The control valve 1 comprises an actuating or control element 2 and a first piston 3 and a second piston 4. A known magnetic controller or a known piezoelectric actuator can for instance be used as the control element 2.

The first piston 3 comprises a plurality of piston portions 3*a* through 3*e*. A first piston portion 3*a* is embodied cylindrically and is connected to the control element 2. This is followed by a second piston portion 3*b*, embodied in concave form, which in an appropriate position of the piston 3 opens a first passage at the valve seat 10. Adjacent to the second piston portion 3*b* is the third piston portion, embodied as a slide element 3*c*. The third piston portion 3*c* is disposed directly at the valve seat 10 or at the first passage. The piston 3 also includes a widening, fourth piston portion 3*d* and a further cylindrical, fifth piston portion 3*e*. The fifth piston portion 3*e* is disposed in a pressure chamber 6 disposed between the first piston 3 and the second piston 4.

The second piston 4 comprises a slide element 4*a* and a base body 4*b*. When the control valve 1 is not actuated, the piston 4 is kept in the open position by a spring 9, so that a second passage 5 between the pressure chamber 6 and a leak fuel line 8 is open. As a result, in the nonactuated state, the leak fuel pressure prevails in the pressure chamber 6.

In the control valve 1 shown in FIG. 1, a guide diameter $d_1$ of the first piston 3 is equal to the slide diameter $d_2$ of the second piston 4. The control valve 1 is thus constructed as a force-compensating valve.

The pressure chamber 6 also communicates with a booster piston 11 via a line 19. The booster piston 11, embodied in multiple stages, is kept in its outset position via a restoring spring 12 and with its smaller piston diameter, it communicates with a control chamber 15. The control chamber 15 is filled with fuel via a filling valve 13 and a fuel line 14. Via an injection nozzle 16, prestressed by a spring 17, the fuel is fed into a combustion chamber, not shown.

The mode of operation of the fuel injection valve will now be described. Upon actuation of the control element 2, the piston 3 is moved onward in the direction of the pressure chamber 6 from its valve seat. Upon opening of the seat, however, a communication is not immediately established between the inflow line 7 from the rail and the pressure chamber 6; instead, a slide height $h_2$ of the slide element 3*c* must be overcome first, before this communication is established. As a consequence of the motion of the piston 3 in the direction of the pressure chamber 6, the piston 4 is closed, counter to the spring force of the spring 9. In this process, a stroke length $h_1$ at the slide element 4*a* must be overcome. Since according to the invention the stroke length $h_2$ of the slide element 3*c* is greater than or at least equal to the stroke length $h_1$ at the piston 4, it is thus assured that no communication between the inflow line 7, in which high pressure prevails, and the leak fuel line 8 will occur.

Once the piston 3 has covered the stroke length $h_2$ in the direction of the pressure chamber 6, the pressure chamber 6 communicates with the high-pressure inflow line 7, so that counter to the pressure of the restoring spring 12, a high pressure is applied to the booster piston 11. This high pressure is transmitted, because of the different diameters of the booster piston 11, to the fuel-filled control chamber 15. As a result, via the pressure shoulder 18 provided at the injection nozzle 16, the force of the spring 17 is overcome, and the fuel is injected into the combustion chamber, not shown.

Upon the return of the control valve 1, because of the stroke length of the slide element 3*c*, the communication between the inflow line 7 and the pressure chamber 6 is interrupted immediately, while the second passage 5 is still closed by the slide element 4*a*, because of the high pressure in the pressure chamber 6. Not until the spring force of the spring 9 becomes greater than the pressure in the pressure chamber 6 does the slide element 4*a* of the piston 4 open the passage 5, thus opening up a communication between the pressure chamber 6 and the leak fuel line 8.

Thus an unambiguous function of the control valve 1 is always assured, both upon opening and upon closing, without a diversion surge from the pressure chamber 6 into the leak fuel line 8 occurring. By the disposition of the slide element 3*c* upstream in the opening direction of the actual opening portion 3*d* of the piston 3, the disadvantages of the prior art can thus be overcome. As a result of the slide ratio $h_2/h_1$, an overlap of the piston 4 can be optimized depending on the application. As a rule, the overlap ($h_2$-$h_1$) is lengthened (that is, will be greater than 0), in order to assure that no surge of leak fuel will occur.

Figure 2:
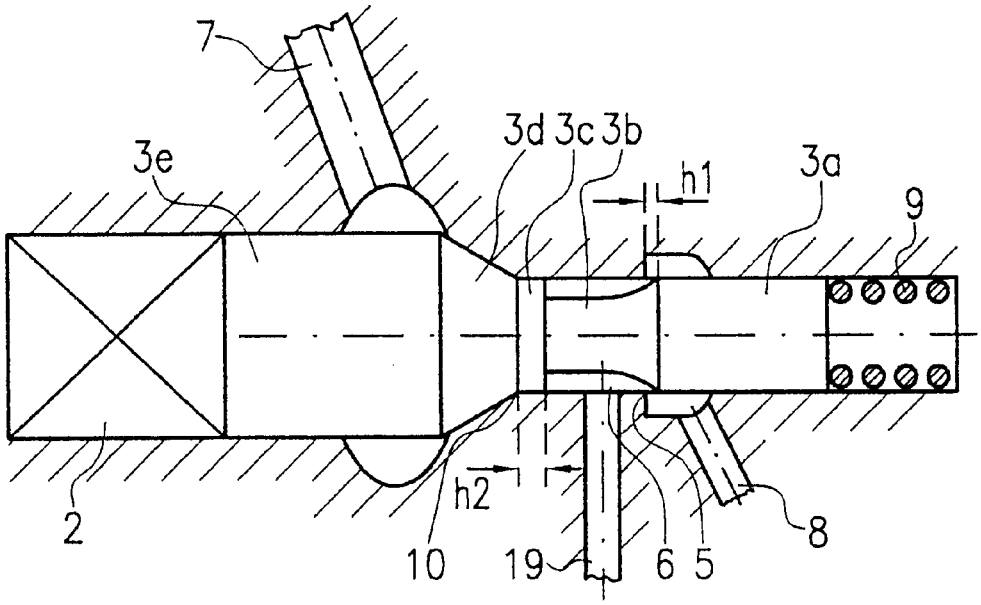
FIG. 2, a schematic fragmentary sectional view through a fuel injection valve in a second exemplary embodiment of the present invention.

In FIG. 2, a second exemplary embodiment of a valve for controlling fluids of the invention is shown. This control valve can again be used in a fuel injection valve. Since the fuel injection valve of the second exemplary embodiment, in comparison with the first exemplary embodiment, has changes only at the control valve 1, the further parts of the fuel injection valve have not been shown in FIG. 2 or described below, since they are embodied precisely as in the first exemplary embodiment. Also in the second exemplary embodiment, the same reference numerals as in the first exemplary embodiment are used for identical parts.

The control valve 1 of the second exemplary embodiment, in contrast to the first exemplary embodiment, has only one piston 3. The piston includes a plurality of piston portions 3*a* through 3*e*. The piston 3 again has a first cylindrical piston portion 3*a* and a second piston portion 3*b* which is embodied in concave form. The second piston portion 3*b* is adjoined by a slide element 3*c*, which is disposed directly at the valve seat. The piston 3 also includes a fourth, tapering piston portion 3*d* and a fifth, cylindrical piston portion 3*e*, which are connected to a control element 2. The piston 3 is disposed partly in a pressure chamber 6 and opens/closes the communication between an inflow line 7 from a rail and a booster piston (not shown) that communicates with the pressure chamber 6 via a line 19. The control valve 1 also includes a leak fuel line 8.

The mode of operation of the control valve 1 of the second exemplary embodiment is as follows. When the control element is actuated, the piston 3 is moved in the direction of the control element 2. As a result, the fourth, tapering piston portion 3*d* lifts away from the piston seat at the first passage at valve seat 10. However, since the slide element 3*c* directly follows the second piston portion 3*b*, the communication between the high-pressure inflow line 7 and the pressure chamber 6 is not opened until the edge, toward the second piston portion 3*b*, of the slide element 3*c* has moved past the valve seat 10.

Since as shown in FIG. 2 the stroke length $h_2$ of the slide element 3*c* is greater than the stroke length $h_1$ provided at the second passage 5 between the first piston portion 3*a* and the second piston portion 3*b*, it is assured that the communication between the pressure chamber 6 and the leak fuel line 8 will be closed before the communication between the inflow line 7 and the pressure chamber 6 is opened via the first passage at seat 10. Upon closure of the control valve 1, the communication between the inflow line 7 and the pressure chamber 6 is first closed, before the passage 5 between the pressure chamber 6 and the leak fuel line 8 is opened.

Thus in the second exemplary embodiment as well, a diversion surge into the leak fuel line 8 upon switchover of the control valve 1 is securely prevented. Moreover, depending on the intended use, the desired overlap ($h_1$–$h_2$) can be adjusted by the ratio of the stroke length $h_2$ of the slide element 3*c* to the stroke length $h_1$ at the second passage 5.

The above description of the exemplary embodiments of the present invention is intended solely for illustrative purposes and is not intended to limit the scope of the invention. Within the scope of the invention, various changes and modifications may be made without departing from the scope of the invention or its equivalents.

I claim:

1. A valve for controlling fluids, comprising an inflow line (7) and a leak fuel line (8), which each communicate with a pressure chamber (6), a piston element (3, 4), which is adjustable by a control element (2) and which opens and closes a first passage between the inflow line (7) and the pressure chamber (6), the piston element (3, 4) having a slide element (3*c*) disposed directly adjacent to a seat (10) for the piston element for controlling the first passage, and a slide element (4*a*) on the piston element (3, 4), for controlling a second passage communicating with the leak fuel line, the slide element (3*c*) having a stroke length ($h_2$) for opening the first passage which is greater than or equal to a stroke length ($h_1$) for closing the second passage.

2. The valve for controlling fluids of claim 1 wherein the valve is embodied as a 3/2-way seat-slide valve.

3. The valve for controlling fluids of claim 1 wherein the valve is embodied as a force-compensating valve.

4. The valve for controlling fluids of claim 1 wherein the valve is embodied as a 3/2-way seat-seat valve.

5. The valve for controlling fluids of claim 4 wherein the valve is embodied as a force-compensating valve.

6. The valve for controlling fluids of claim 1 wherein the piston element (3) is embodied in one piece.

7. The valve for controlling fluids of claim 6 wherein the valve is embodied as a 3/2-way seat-slide valve.

8. The valve for controlling fluids of claim 6 wherein the valve is embodied as a 3/2-way seat-seat valve.

9. The valve for controlling fluids of claim 6 wherein the valve is embodied as a force-compensating valve.

10. The valve for controlling fluids of claim 1 wherein the piston element includes a first piston (3) and a second piston (4).

11. The valve for controlling fluids of claim 10 wherein the valve is embodied as a 3/2-way seat-slide valve.

12. The valve for controlling fluids of claim 10 wherein the valve is embodied as a 3/2-way seat-seat valve.

13. The valve for controlling fluids of claim 10 wherein the valve is embodied as a force-compensating valve.

14. The valve for controlling fluids of claim 1 wherein the slide element (3*c*) is embodied cylindrically.

15. The valve for controlling fluids of claim 14 wherein the piston element (3) is embodied in one piece.

16. The valve for controlling fluids of claim 14 wherein the valve is embodied as a 3/2-way seat-slide valve.

17. The valve for controlling fluids of claim 14 wherein the valve is embodied as a 3/2-way seat-seat valve.

18. The valve for controlling fluids of claim 14 wherein the valve is embodied as a force-compensating valve.

19. The valve for controlling fluids of claim 14 wherein the piston element includes a first piston (3) and a second piston (4).

20. The valve for controlling fluids of claim 19 wherein the valve is embodied as a 3/2-way seat-slide valve.

* * * * *